US007722013B2

(12) United States Patent
Franzen et al.

(10) Patent No.: US 7,722,013 B2
(45) Date of Patent: May 25, 2010

(54) COMBINATION DOUBLE BOTTOM BLOCK

(75) Inventors: Hans-Peter Franzen, Walshausen (DE); Alfred Boes, Eschringen (DE)

(73) Assignee: Terex Demag GmbH, Zweibrucken (DE)

( * ) Notice: Subject to any disclaimer, the term of this patent is extended or adjusted under 35 U.S.C. 154(b) by 127 days.

(21) Appl. No.: 11/991,187

(22) PCT Filed: Aug. 24, 2006

(86) PCT No.: PCT/DE2006/001510

§ 371 (c)(1),
(2), (4) Date: Feb. 28, 2008

(87) PCT Pub. No.: WO2007/028357

PCT Pub. Date: Mar. 15, 2007

(65) Prior Publication Data

US 2009/0267039 A1 Oct. 29, 2009

(30) Foreign Application Priority Data

Sep. 6, 2005 (DE) ..... 10 2005 043 061

(51) Int. Cl.
*B66D 3/08* (2006.01)

(52) U.S. Cl. ..... 254/393; 254/399; 254/401; 294/82.11

(58) Field of Classification Search ..... 254/337, 254/385, 393, 399, 401; 294/82.1, 82.11, 294/82.15, 86.41
See application file for complete search history.

(56) References Cited

U.S. PATENT DOCUMENTS

| | | | | |
|---|---|---|---|---|
| 3,794,185 | A * | 2/1974 | Kroll et al. | 254/399 |
| 3,936,034 | A * | 2/1976 | Larralde | 254/399 |
| 4,098,492 | A * | 7/1978 | Wilkinson | 254/399 |
| 6,595,494 | B1 | 7/2003 | Roodenburg et al. | |
| 6,651,961 | B1 | 11/2003 | Meyer | |
| 7,469,882 | B2 * | 12/2008 | Frommelt | 254/393 |
| 7,543,799 | B2 * | 6/2009 | Willis et al. | 254/336 |

FOREIGN PATENT DOCUMENTS

| | | |
|---|---|---|
| DE | 37 36 287 | 9/1988 |

OTHER PUBLICATIONS

Search Report dated Nov. 29, 2006 for the underlying International PCT Application No. PCT/DE2006/001510.

* cited by examiner

*Primary Examiner*—Evan H Langdon
(74) *Attorney, Agent, or Firm*—Browdy and Neimark, PLLC

(57) ABSTRACT

The invention relates to a combination double bottom hook block in which two pulley blocks (2, 3) each with a plurality of pulleys are connected to one another by means of a rocker (1), a load hook being mounted in a pivotable manner on the rocker. If use is made here of two lifting cables, each of these lifting cables is led over a pulley block (2, 3) and, in order to achieve the same loading capability if use is made of just one lifting cable, the latter is led, in addition, over a floating pulley (2) which is mounted between the two pulley blocks (2, 3), the two pulley blocks (2, 3) also being secured against tilting.

5 Claims, 3 Drawing Sheets

COMBINATION DOUBLE BOTTOM BLOCK

CROSS-REFERENCE TO RELATED APPLICATIONS

This is a U.S. national stage of International Application No PCT/DE2006/001510, filed on 24 Aug. 2006. Priority is claimed on German Application No. 10 2005 043 061.9, 6 September 2005.

BACKGROUND OF THE INVENTION

1. Field of the Invention

The invention pertains to a combination double bottom block of a block and tackle arrangement in which two pulley blocks, each with several small pulleys, are connected to each other by a rocker, and where a load hook is supported on the rocker.

2. Description of the Related Art

Depending on the various combinations of working loads and boom lengths, crane operators have been forced until now to use a double bottom block in certain working load situations.

In the case of short boom systems, however, the operator can also work with a single hoist winch.

In the case of conventional bottom blocks, conversion of the conventional double bottom block leads to a halving of the working load which can be lifted.

If the operator wants to lift working loads of more than 50% of the nominal working load on the boom, he must use an additional, larger single bottom block or work with a double bottom block.

Double bottom blocks, however, require two pulley blocks, which are a certain distance apart and connected to each other by a rocker.

When two hoisting cables are being used, this rocker with the double bottom blocks makes it possible for balancing operations to occur within the hook block.

These pulley blocks can be converted to a half-size single bottom block by shifting one of the pulley blocks to the center of the bottom block and by removing the other pulley block.

As a result, however, the nominal working load is cut by 50%, e.g., from 320 tons to 160 tons.

If the two pulley blocks are locked to allow the use of a single hoisting cable, the gap remaining between the pulley blocks must be bridged.

This usually leads to large angles of deflection, which can be reduced only by increasing the distance between the pulley block on the crane and the bottom block.

This leads to an undesirable reduction in the possible lifting height.

Furthermore, with each receiving arrangement care must be taken to ensure that the moments are in equilibrium around the center axis of the block.

It has been found repeatedly that it is highly favorable for a small pulley to be located in the geometric center of the block.

This behaves neutrally with respect to the moment relationships of the receiving.

The two pulley blocks of a double bottom block thus almost always have an odd number of small pulleys.

If the double bottom block is now locked, what is created out of the two pulley blocks, each with, for example, 5 small pulleys, is one large single block with an unfavorable 10 small pulleys and a gap in the geometric center of this hook block.

The task of the invention is to eliminate this problem.

SUMMARY OF THE INVENTION

According to the invention, this task is accomplished in that, when two hoisting cables are used, each of these hoisting cables is conducted over a pulley block and that, to achieve the same load capacity when only one hoisting cable is used, this cable is also conducted over a floating pulley supported between the two pulley blocks, where, in addition, the two pulley blocks are locked to prevent them from tilting.

The core idea of the invention therefore lies in taking advantage of the fact that the conventional double bottom block usually has a mounting bore in the geometric center of its shell for one of the two pulley blocks or that there is at least a geometric gap here.

When the hook block is used as a double bottom block in double-cable operating mode, this mount is unused.

According to the invention, use is now made of this mount, in that the two pulley blocks are locked with pins to prevent them from tilting, and a small floating pulley is introduced between these two pulley blocks.

As a result, what is obtained is, so to speak, an odd-numbered single bottom block, which handles the maximum working load of the crane in the case of short booms.

Receiving arrangements with small angles of deflection now become possible again.

Another advantage is that the pulley blocks of the bottom block do not have to be removed, as previously described, or shifted. On the contrary, they are merely locked with pins.

The additional small pulley can be pinned in place to the free mount in the center of the rocker.

Alternatively, however, it can also be screwed, bolted, or otherwise suspended between the two locked pulley blocks.

The following advantages are obtained by the inventive solution:

The crane operator can save on the purchasing cost.

Conversion times are shorter.

The number of possible applications is increased, because only one additional possible application was created. The previous applications of the standard double bottom block, i.e., a block which can be converted to a single block of half the original size, remain preserved.

Under certain conditions, the operator can eliminate a third winch or a larger single block.

The manufacturer can offer a larger number of possible applications with a block.

BRIEF DESCRIPTION OF THE DRAWINGS

The invention is to be explained below on the basis of an exemplary embodiment.

DETAILED DESCRIPTION OF THE PREFERRED EMBODIMENTS

Figure 2:
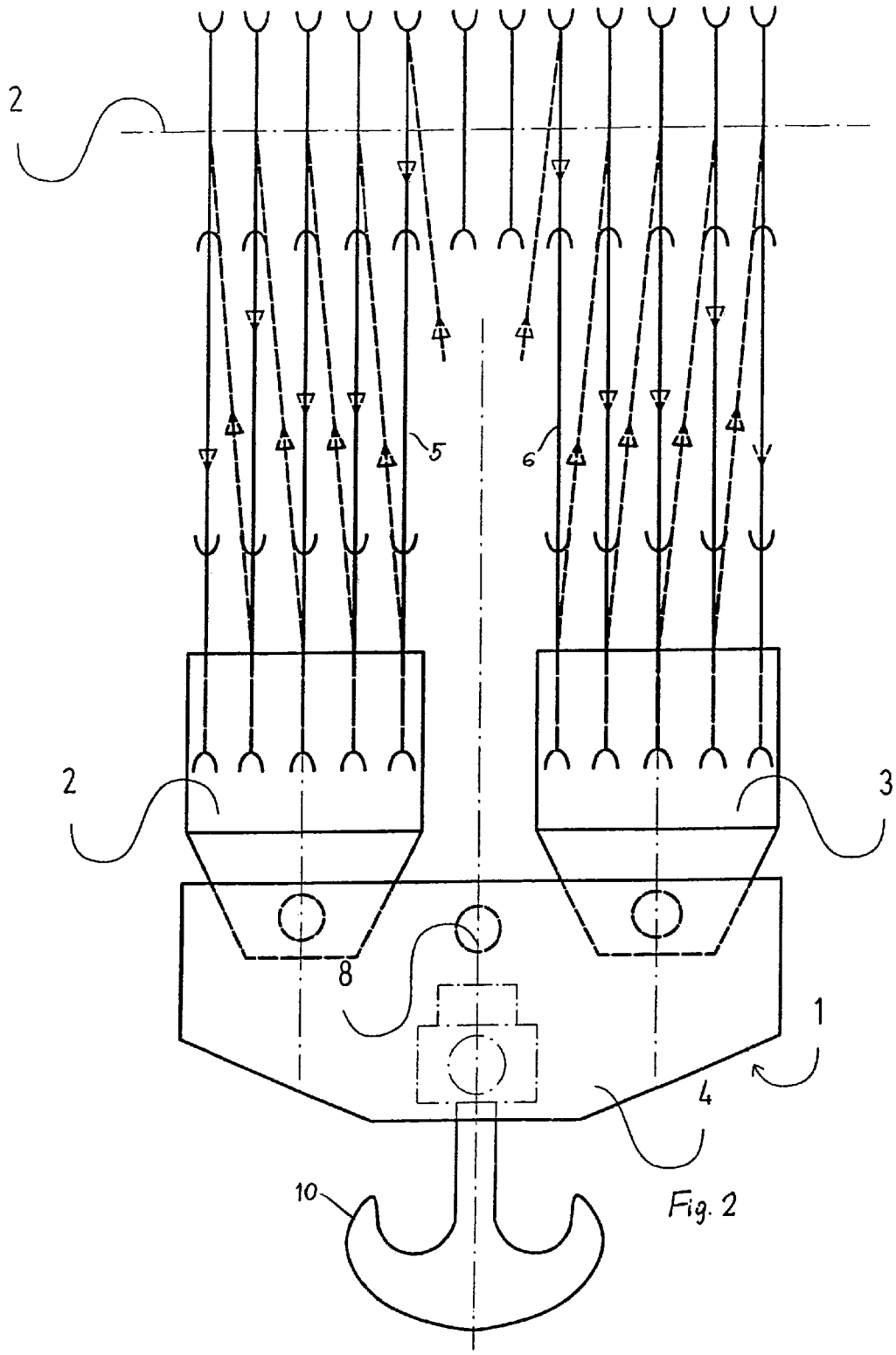
FIG. 2 shows a double bottom hook block using a double cable arrangement.

FIG. 2 shows a double bottom block 1 of conventional design, in which two pulley blocks 2 and 3 are connected by the rocker 4. It can be seen from the layout of the cables that two hoisting cables 5 and 6 are provided. The load hook 10 connected to the rocker 4 is suspended centrally between the pulley blocks 2 and 3. This double bottom block is designed for a load of, for example, 2×160 tons.

Figure 1:
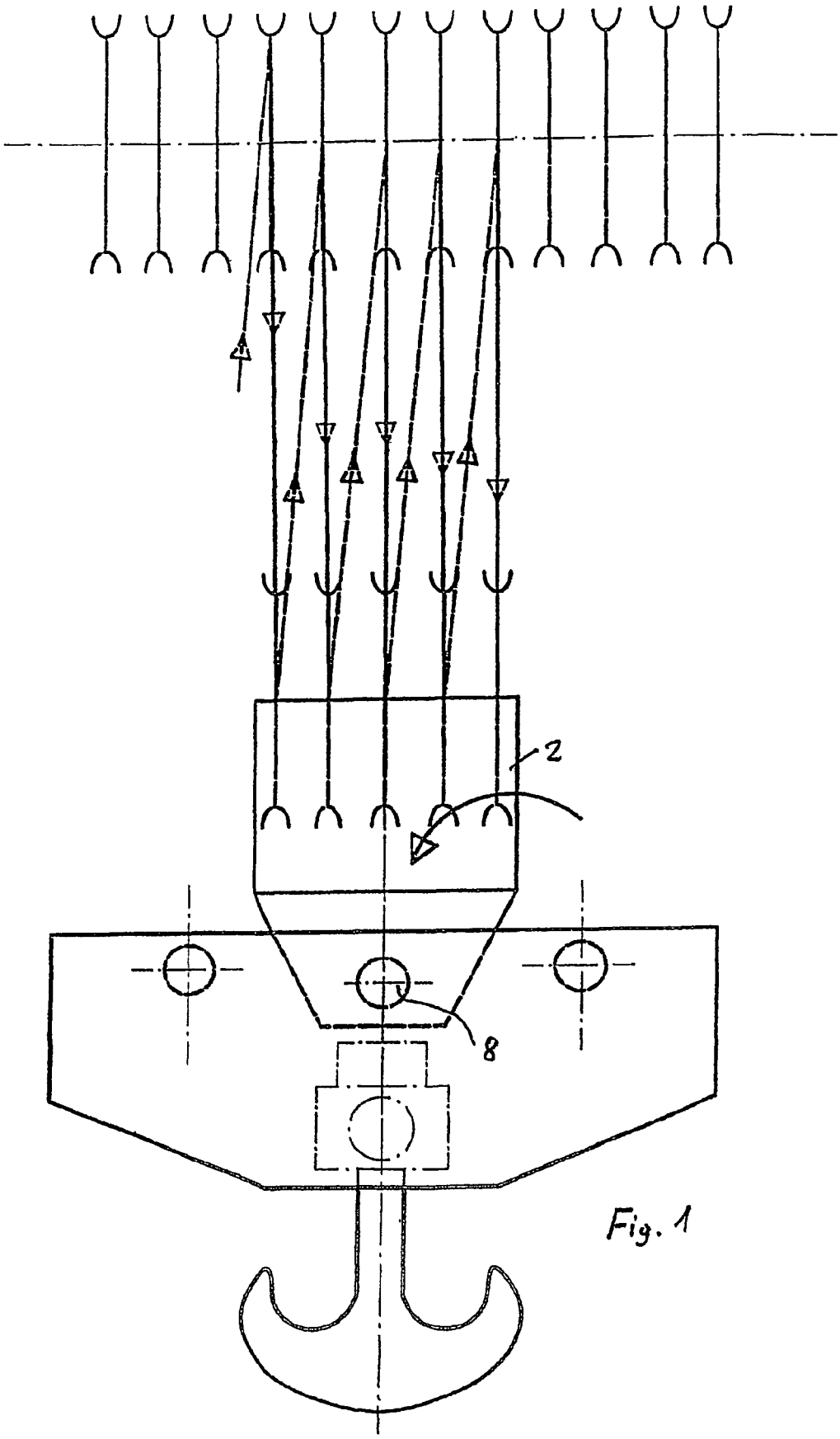
FIG. 1 shows a double bottom hook block using a single hoisting cable.
Figure 3:
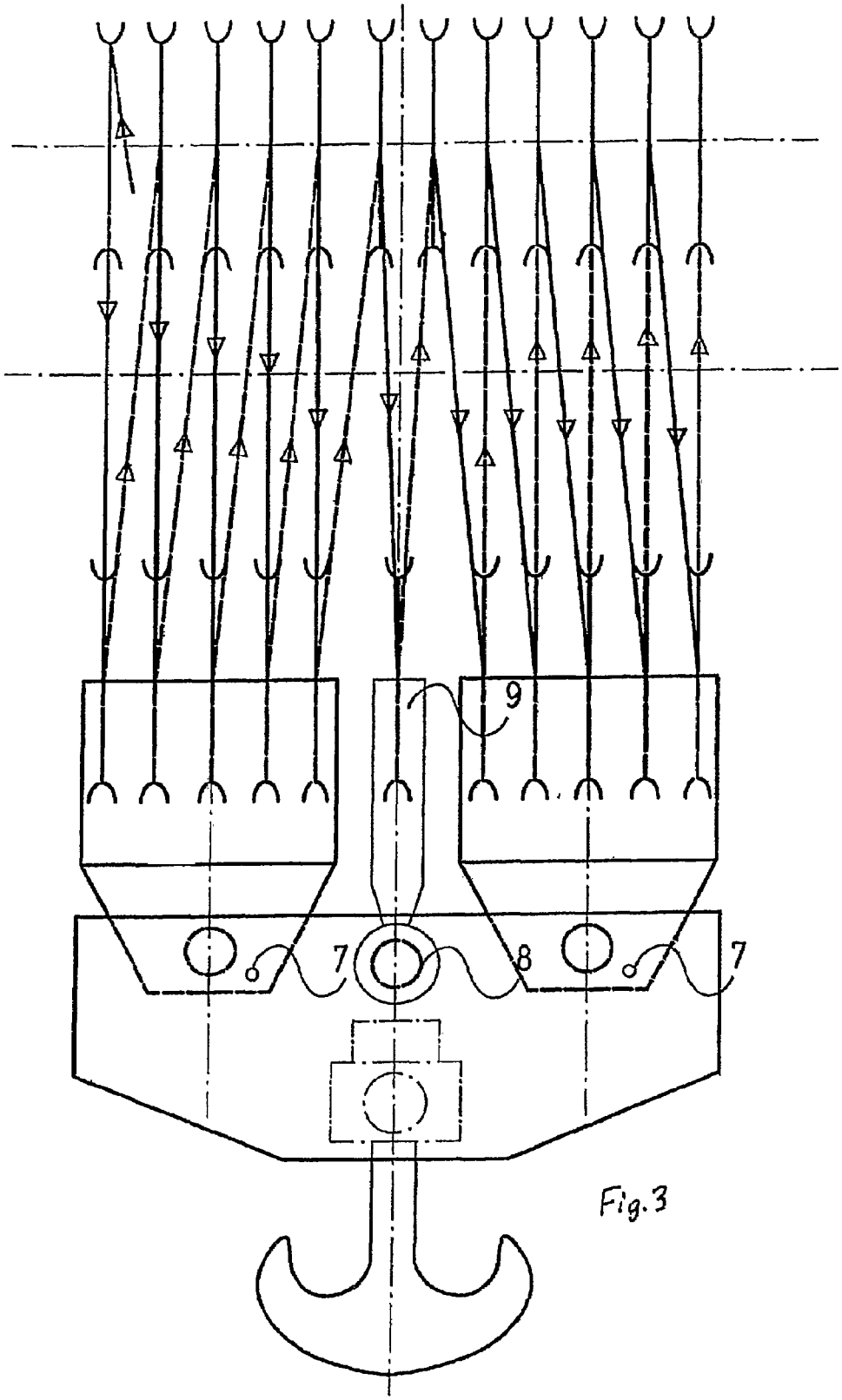
FIG. 3 shows a double bottom hook block with a pulley block using a single hoisting cable.

If the two pulley blocks 2 and 3 were to be replaced by a single pulley block 2, as shown in FIG. 1, this block would have to be arranged in the center. For this purpose, the existing mount 8 would be used. The disadvantage here is that then the possible load would be reduced by half, that is, to 1×160 tons. When only one hoisting cable is used, this disadvantage can be avoided by keeping the two conventional pulley blocks 2 and 3 on the rocker 4, but—as indicated in FIG. 3—by bolting them down with bolts or pins 7 to prevent them from tilting. In addition, a floating pulley 9 for guiding the cable is provided, and this pulley can be bolted in place in the mount 8, for example.

What is claimed is:

1. A double bottom block, comprising:

a pair of pulley blocks, each block having a plurality of pulleys;

a rocker connecting the pair of pulley blocks, the rocker having a load hook for supporting a load centrally between the pair of pulley blocks; and a floating pulley introduced, axially aligned with and supported centrally between the pair of pulley blocks so that a single cable is conductable over each of said plural pulleys of the pair of pulley blocks and the floating pulley;

wherein the pair of pulley blocks is lockable to prevent said pair of pulleys blocks from tilting.

2. The double block of claim 1, further comprising:

means for locking the pair of pulley blocks on the rocker so that the pair of pulley blocks cannot tilt with respect to the rocker.

3. The double block of claim 2, further comprising:

a mount located in the rocker centrally between the pair of pulley blocks, the floating pulley being installed in the mount.

4. The double block of claim 1 wherein a total number of pulleys, including the floating pulley, is an odd number.

5. A double bottom block comprising:

a pair of pulley blocks, each block having a plurality of pulleys;

a rocker connecting the pair of pulley blocks, the rocker having a load hook for supporting a load centrally between the pair of pulley blocks;

a floating pulley introduced, axially aligned with and supported centrally between the pair of pulley blocks so that a single cable is conductable over each of said plural pulleys of the pair of blocks and the floating pulley;

means for locking the pulley blocks on the rocker so that the pair of pulley blocks cannot tilt with respect to the rocker; and a mount located in the rocker centrally between the pair of pulley blocks, the floating pulley being bolted in the mount;

wherein the pair of pulley blocks is locked to prevent said pair of pulley blocks from tilting.

* * * * *